US005182418A

United States Patent [19]

Talley

[11] Patent Number: 5,182,418

[45] Date of Patent: Jan. 26, 1993

[54] AIMABLE WARHEAD

[75] Inventor: James C. Talley, Dahlgren, Va.

[73] Assignee: The United States of America as represented by the Secretary of the Navy, Washington, D.C.

[21] Appl. No.: 465,806

[22] Filed: Jun. 21, 1965

[51] Int. Cl.[5] ..... F42B 12/02; F42C 13/00

[52] U.S. Cl. ..... 102/475; 102/211; 102/701

[58] Field of Search ..... 102/70.2, 21.6, 57, 102/58, 67, 68, 305, 306, 475, 476, 492, 211, 701

[56] References Cited

U.S. PATENT DOCUMENTS 2,412,151 12/1946 Holmes ..... 102/473
2,713,308 7/1955 Brown et al. ..... 102/403
2,925,965 2/1960 Pierce ..... 102/213
3,118,375 1/1964 Jasse ..... 102/202.8
3,136,251 6/1964 Witow ..... 102/211
3,145,656 8/1964 Cook et al. ..... 102/474
3,170,402 2/1965 Morton et al. ..... 102/474

*Primary Examiner*—Charles T. Jordan
*Attorney, Agent, or Firm*—John D. Lewis; Jacob Shuster

[57] ABSTRACT

An aimable warhead in which a plurality of detonators is disposed about the periphery of an explosive charge with a proximity selector means provided for sensing the location of a target in relation to the warhead and thereafter selectively initiating one of the detontators opposite the side from which the explosion is to be directed in order that the resulting explosion wave may be directed toward the target.

5 Claims, 2 Drawing Sheets

AIMABLE WARHEAD

Figure 1:
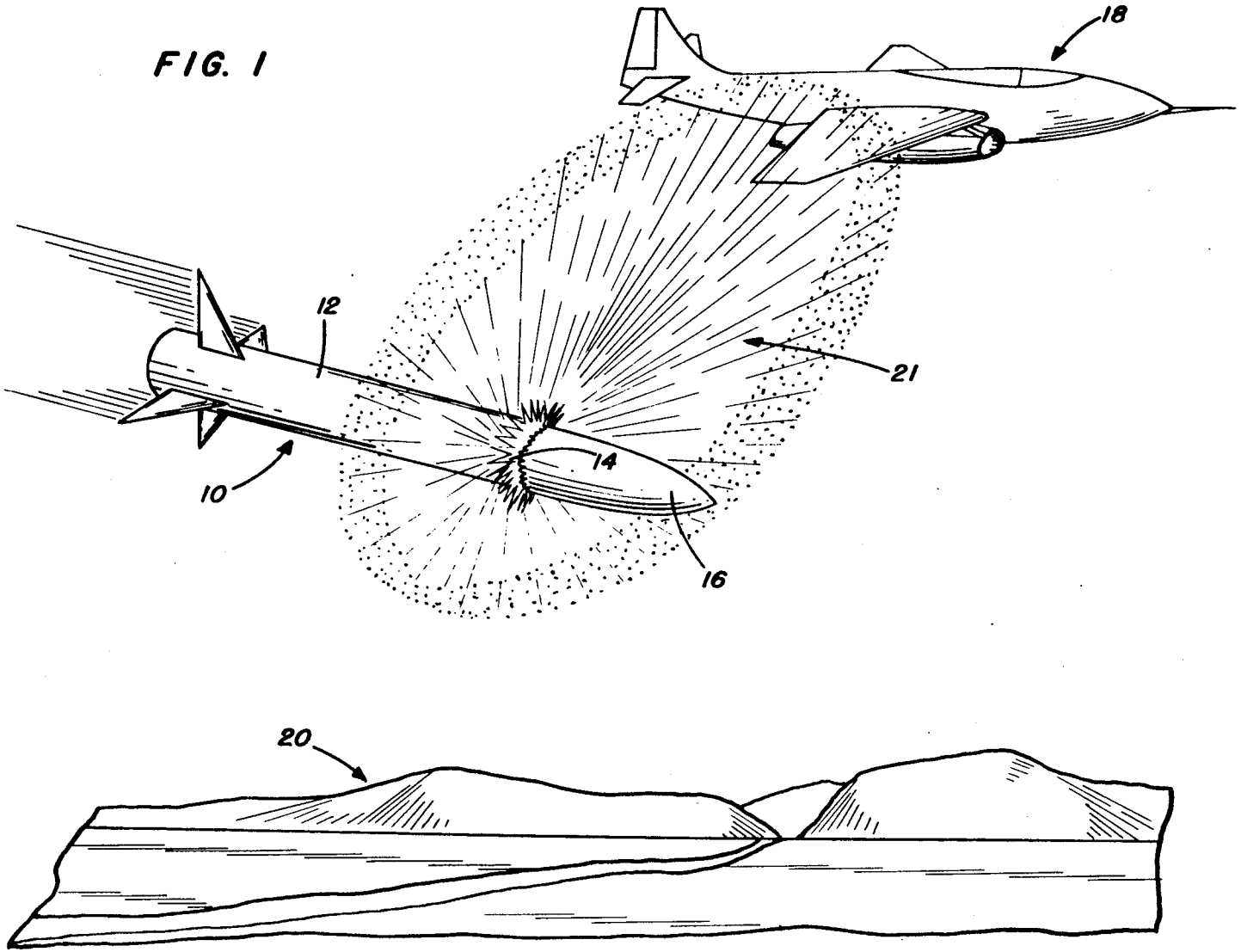

The invention described herein may be manufactured or used by or for the Government of the United States of America for governmental purposes without the payment of any royalties thereon or therefor.

The present invention relates to an explosive warhead, and, more particularly, to a warhead in which the blast or wave front of an explosion can be aimed as to direction so as to improve the likelihood of hitting a target.

The advantages of aiming or controlling the direction of the explosion of a warhead are obvious. For example, in an anti-aircraft missile a direct hit with the target is seldom realized. In most instances, when the missile passes within a predetermined lethal distance from the target, a proximity fuse, preferably located on the missile, commands the warhead to explode thereby causing shrapnel or shell fragments to be projected against the target. Of course, if the missile and target do not pass within the lethal range of the warhead, the proximity device will not cause initiation of the warhead and the shot will be wasted. Accordingly, various methods have been devised in an attempt to increase the effective range of the warhead explosion. For example, improved explosive compositions and fragmentation or shrapnel devices have been employed with considerable success. Another method, though unsucessful in the past, is the aimable warhead. With this method the explosion of the warhead is aimed toward the target so that a greater proportion of the total explosive and shrapnel are projected in the direction of the target-than is otherwise possible.

Various prior art methods have been attempted in the past to provide a workable and dependable aimable warhead. Most of these comprise mechanical methods such as weakening the casing of the warhead in the direction of the target to thereby make it easier for the exploding matter to burst out in that direction. This may be accomplished in either of two ways. The first, when the warhead casing is weakened at a predetermined location prior to missile launch, has the obvious limitation of being aimable in one direction only. Should the missile approach the target with the weakened section of the casing on the side of the missile opposite the target, the explosion would be directed away from the target rather than towards it. The second method of weakening the casing is somewhat more sophisticated than the first in that the casing is weakened at a particular location just prior to detonation of the warhead. This is accomplished, for example, by providing a plurality of small explosive charges spaced around the periphery of the casing. After a target is located by a proximity fuse, the explosive charges on the side of the warhead nearest the target are detonated so as to weaken the casing on that side just prior to initiation of the main explosive charge. Although this method has proven somewhat satisfactory, difficulties have been encountered both in timing the detonation of the case weakening explosive charges, particularly when high missile-target closing speeds are encountered, and also in the possibility of premature ignition damage to the main explosive charge. Furthermore, in both of the above prior art methods of obtaining a directional explosion, weakening of the casing is usually not sufficient to achieve directionality of the blast wave front in a high explosive warhead since the strength of the casing is negligible in comparison with the explosive force.

The general purpose of this invention, therefore, is to provide an aimable warhead which embraces all of the advantages of similarly employed warheads and which possesses none of the afore-described disadvantages. To attain this, the present invention utilizes a unique explosive initiation system whereby a plurality of detonators are positioned around the periphery of the warhead explosive so that the explosion thereof may be aimed merely by firing one or more selected detonators.

Accordingly, an object of the present invention is to provide a warhead, the explosion of which can be aimed in any desired direction.

Another object of the present invention is to increase the lethal range of an explosive warhead.

A further object of the invention is the provision of a warhead wherein the velocity and the amount of fragmentation resulting from an explosion thereof are increased in the direction of aim.

Still another object is to provide a warhead having an increased destructive effect in the direction of the target.

Yet another object of the present invention is the provision of a warhead, the destructible force of which is aimable in any direction around the longitudinal axis thereof.

A still further object is to provide an aimable warhead which is characterized by simplicity of construction, which is light in weight, which requires little additional equipment to provide aiming and which can be aimed almost instantaneously.

Figure 2:
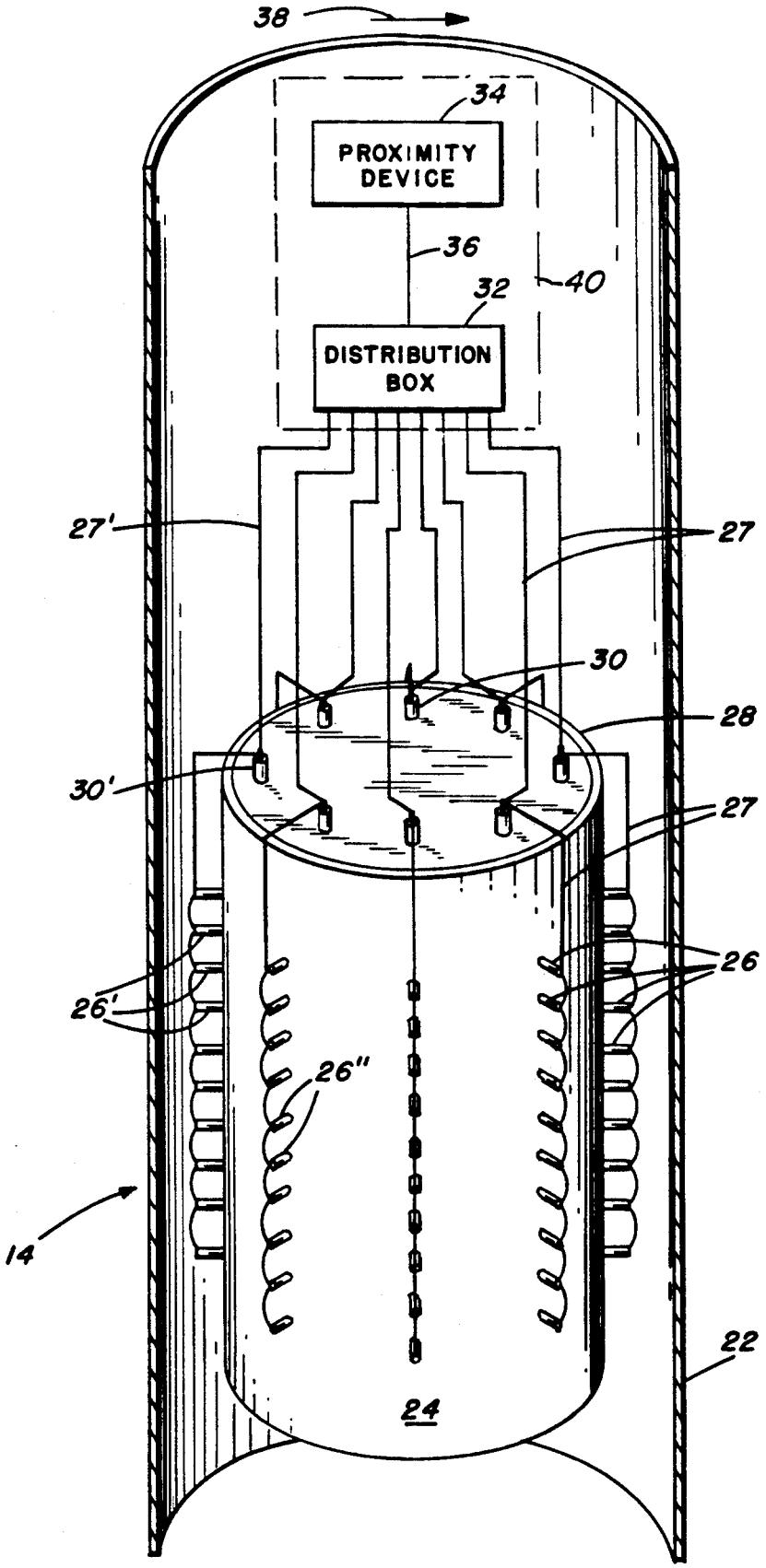

Other objects and many of the attendant advantages of this invention will be readily appreciated as the same become better understood by reference to the following detailed description when considered in connection with the accompanying drawings in which:

FIG. 1 is a diagrammatic view of the present invention in an operative environment; and FIG. 2 is a side elevation view, partly in section, of the warhead of the present invention.

Briefly, the present invention aims the blast and fragmentation resulting from the warhead explosion by initiating one or more detonators on the side of the explosive material opposite the target. The detonators may be initiated either simultaneously or sequentially depending on the position of the target relative to the missile and the shape of the explosive pattern desired.

Basically, the mechanism of explosion involves a chemical exothermic reaction. When a homogeneous mass of a high explosive material is initiated at one point, the resulting detonation front travels uniformly through the charge as an expanding sphere. In the case of a centrally initiated spherical charge, the detonation front arrives simultaneously at all points on the surface of the sphere. In the case of a centrally initiated cylindrical warhead, the detonation front initially forms as an expanding sphere until the portion of the surface of the cylinder nearest the point of initiation is reached. Thereafter, the detonation front travels through the remainder of the charge as an expanding segment of a sphere until the entire explosive mass is consumed. In either a spherical or a cylindrical warhead, therefore, the resulting blast wave and fragmentation is projected from the warhead in a generally uniform manner in all directions.

The present invention causes the resulting blast wave and fragmentation material to be projected from the warhead in a non-uniform manner so that a greater proportion thereof is directed towards the target. This is accomplished by initiating the explosive charge, whether spherical, cylindrical or in any similar other form, on the surface of the charge opposite the target. By initiating detonation of the explosive charge on the side opposite the target the resulting detonation wave forms immediately adjacent to the detonator and proceeds through the explosive charge at a high but constant rate. When the wave so formed reaches the opposite side of the charge, it ruptures the casing and causes the resulting blast wave and fragmentation material to be projected in the same direction as the wave was traveling within the explosive material. Therefore, the resulting blast wave and fragmentation material are not projected in a uniform manner around the longitudinal axis of the missile but rather are projected in increased quantities and at higher velocities in the direction of the target than in other directions.

If desired, a plurality of closely spaced detonators on the side opposite the target could be initiated either simultaneously or sequentially in such a manner as to enhance the directional characteristics and force of the resulting explosion. With this type of detonation, converging detonation fronts with the explosive material are formed. These fronts influence the ejection angle of fragments on the side of the warhead opposite the detonation point, thereby causing an increase in the mass projected toward the target. Furthermore, as compared with a centrally initiated explosive charge, the impulse is increased both because of the greater thickness of explosive material the detonation wave traverses before reaching the opposite surface and because of the pressure increases caused by the interaction of the combining wave fronts within the explosive material.

Referring now to the drawings wherein like reference characters designate like or corresponding parts throughout the several views, there is shown in FIG. 1, an anti-aircraft missile, indicated generally by reference character 10, having a propulsion section 12, an aimable warhead section 14 and a guidance and control section 16. As illustrated, the missile 10 is intercepting a target aircraft 18 over terrain 20 with the explosion 21 being directed toward the aircraft 18.

Referring now to FIG. 2, wherein the warhead section 14 is shown in detail, the outer shell 22 of the missile 10 surrounds a cylindrical block of explosive material 24. A plurality of rows of radially extending detonators 26 are equally spaced about the periphery of the warhead 24 and are disposed within the casing 28 thereof. The casing 28 may be of the fragmentation or shrapnel type and the detonators may be of the series spark gap type, the latter being more completely described in the co-pending application Ser. No. 286,138, filed Jun. 5, 1963 by W. L. Gilbertson and D. D. Abernathy. Each row of detonators 26 is connected in series by means of wires 27 to a power supply mechanism 30 and to a control box 32. A proximity device 34 of a character well known in the art is electrically connected to the control box 32 by means of a wire 36. Distribution box 32 and the proximity device 34 are component parts of proximity selector means 40 which performs as follows.

In operation, the proximity device 34, of the proximity selector means 40, senses the location of the target in terms of azimuth angle about the longitudinal axis of the missile and transmits electrical signals indicative of this information to the distribution box 32, also of the proximity selector means 40, via wire 36. The distribution box 32 then selects the row or rows of detonators to be initiated. For example, if the target is located to the right of the missile as viewed in FIG. 2, the desired aim direction of the explosion is as indicated by arrow 38. Distribution box 32 then sends a signal to the power supply 30' via electrical interconnection 27' which in turn initiates the row of detonators indicated by reference characters 26'. Alternatively, two strings of detonators 26' and 26'' could be actuated either simultaneously or sequentially so as to shift the aim direction around the longitudinal axis of the missile. Once initiated, the selected detonator or detonators cause actuation of the warhead explosive charge in a conventional manner. Although aim selection is essentially simultaneous with detonation, control is exerted only by means of selecting the initiators. Phenomena occurring during the detonation process are not used for control.

Obviously, the directionally aimed warhead may be employed to considerable advantage against any target which can be identified by the fusing and guidance of the missile. For example, appropriate targets may be aircraft, missiles or radar antenna or any heat emitter such as a vehicle or a ship. Furthermore, the concept of the aimable warhead of the present invention may be utilized in other than missile systems, for example, in gun launched shells and aircraft bombs.

The advantages of kill mechanism concentration to achieve improved effectiveness are obvious. A warhead may be reduced in size for equal effectiveness or have greater effectiveness in the same size. The quick aimable feature and the possibility of controlling the explosive beam width permits the use of optimum concentration upon the target and reduction of wasted affect in directions in which there is no target.

It is to be understood, of course, that the foregoing disclosure relates to a preferred embodiment of the invention and that many modifications or alterations may be made therein without departing from the spirit and scope of the invention as set forth in the appended claims. For example, the external shape of the explosive charge 24 may be varied to suit varying conditions the internal features of the explosive charge 24 may be varied for specific applications and the charge to mass ratio of the explosive material 24 may be varied to meet specific target requirements.

What is claimed is:

1. An explosive device comprising:

a charge of explosive material;

a plurality of detonators spaced around the periphery of said explosive material; and a proximity selector means for sensing the location of the target and thereafter selectively initiating at least one of said detonators opposite the side from which the explosion is to be directed, whereby the direction of the explosion of said charge may be controlled.

2. An explosive device in accordance with claim 1 wherein said detonators comprise:

a plurality of rows of detonators, each of said detonators being radially disposed within said charge.

3. An explosive device in accordance with claim 2 wherein:

said detonators are of the series spark gap type.

4. An aimable warhead comprising:

a cylindrical charge of explosive material;

fragmentation means surrounding said charge;

a plurality of detonators disposed around the periphery of said fragmentation means, said detonators being embedded within said fragmentation means and said charge;

a proximity selector means for locating the direction of a target and thereafter firing only the detonators on the side of the charge opposite the target, whereby the resulting explosion wave and fragmentation material are projected toward the target.

5. An aimable warhead in accordance with claim 4 wherein said detonators comprise:

a plurality of rows of detonators of the series spark gap type.

* * * * *